US009927766B2

(12) United States Patent
Miyamoto

(10) Patent No.: US 9,927,766 B2
(45) Date of Patent: Mar. 27, 2018

(54) REMOVABLE UNIT AND IMAGE FORMING APPARATUS THEREWITH

(71) Applicant: KYOCERA Document Solutions Inc., Osaka (JP)

(72) Inventor: Takuya Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/648,952

(22) Filed: Jul. 13, 2017

(65) Prior Publication Data

US 2018/0039225 A1 Feb. 8, 2018

(30) Foreign Application Priority Data

Aug. 4, 2016 (JP) ..... 2016-153812

(51) Int. Cl.
*G03G 21/18* (2006.01)

(52) U.S. Cl.
CPC ..... *G03G 21/1803* (2013.01)

(58) Field of Classification Search
CPC ..... G03G 21/1803; G03G 21/1832; G03G 21/1817; G03G 21/08
See application file for complete search history.

(56) References Cited

U.S. PATENT DOCUMENTS

2008/0080891 A1* 4/2008 Noh ..... G03G 21/1803 399/111
2015/0125179 A1* 5/2015 Sakuma ..... G03G 21/1814 399/111
2015/0277359 A1* 10/2015 Abe ..... G03G 21/08 399/128

FOREIGN PATENT DOCUMENTS

JP 9-90833 A 4/1997

* cited by examiner

*Primary Examiner* — Sandra Brase
(74) *Attorney, Agent, or Firm* — Stein IP, LLC

(57) ABSTRACT

A removable unit has a first unit removably attached to an image forming apparatus, a second unit held by being removably attached to the first unit, and a cover member. The cover member is supported pivotably on the first unit, and can be located selectively either in a first position overlapping, or a second position not overlapping, the attachment/removal path of the second unit. When the cover member pivots from the first position to a third position pivoted through a predetermined angle from the first position toward the second position, from the first unit a reaction force acts on the cover member to restrict its pivoting toward the second position and, when the cover member pivots from the second position to the third position, from the first unit a reaction force acts on the cover member to restrict its pivoting toward the first position.

9 Claims, 7 Drawing Sheets

REMOVABLE UNIT AND IMAGE FORMING APPARATUS THEREWITH

INCORPORATION BY REFERENCE

This application is based upon and claims the benefit of priority from the corresponding Japanese Patent Application No. 2016-153812 filed on Aug. 4, 2016, the entire contents of which are incorporated herein by reference.

BACKGROUND

The present disclosure relates to image forming apparatuses employing electrophotography, such as copiers, printers, facsimile machines, and multifunction peripherals having their functions integrated together. More particularly, the present disclosure relates to removable units that are removably attached to the main body of an image forming apparatus, and to image forming apparatuses provided with such a removable unit.

Conventionally, in an image forming apparatus employing an electrophotographic process, image formation generally proceeds as follows: An electrostatic latent image is formed on an image carrying body (photosensitive drum) of which the surface is electrostatically charged uniformly, and by use of a developing unit, a toner image corresponding to the electrostatic latent image is formed on the image carrying body. Then, by use of a transferring member, such as a transfer roller, that forms a transfer nip with the photosensitive drum, the toner image formed on the image carrying body is transferred to a sheet that comes conveyed. The sheet is then passed through a fixing unit, so that the toner image is fixed to the sheet.

Such an image forming apparatus is provided with a destaticizing device for eliminating the residual electric charge on the image carrying body after the transfer of the toner image formed on the image carrying body to the sheet in preparation for the formation of the subsequent electrostatic latent image.

For example, one known image forming apparatus is provided with: a transferring/charging device that transfers, to a sheet, developer fed from a developing device to a photosensitive body and that in addition electrostatically charges the photosensitive body with a potential of a polarity different from that of the potential with which it has been electrostatically charged by a charging device; and destaticizing means for eliminating, by irradiation of light of a predetermined wavelength, the electric charge produced by the transferring/charging device.

SUMMARY

According to one aspect of the present disclosure, a removable unit includes a first unit, a second unit, and a cover member. The first unit is removably attached to an image forming apparatus. The second unit is held by being removably attached to the first unit. The cover member is supported pivotably on the first unit, and can be located selectively either in a first position overlapping the attachment/removal path of the second unit or a second position not overlapping the attachment/removal path of the second unit. When the cover member pivots from the first position to a third position pivoted through a predetermined angle from the first position toward the second position, from the first unit a reaction force acts on the cover member to restrict its pivoting toward the second position and, when the cover member pivots from the second position to the third position, from the first unit a reaction force acts on the cover member to restrict its pivoting toward the first position.

Further features and advantages of the present disclosure will become apparent from the description of embodiments given below.

DETAILED DESCRIPTION

Figure 1:
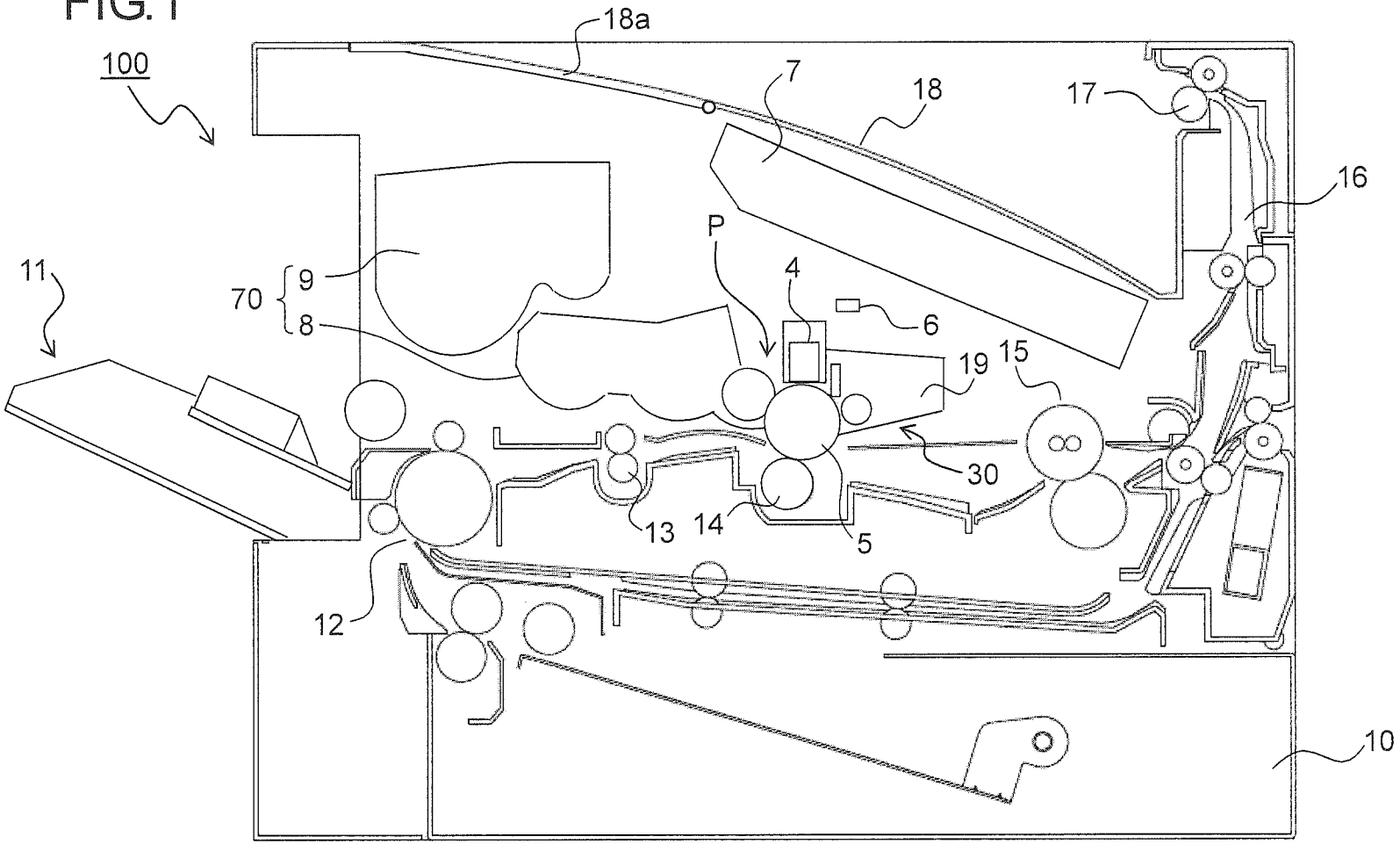
FIG. 1 is a side sectional view showing an internal structure of an image forming apparatus provided with a drum unit according to the present disclosure.

An embodiment of the present disclosure will be described below with reference to the accompanying drawings. FIG. 1 is a side sectional view showing an internal structure of an image forming apparatus 100 provided with a drum unit 30 according to the present disclosure. Inside the image forming apparatus (here, a monochrome printer) 100, there is arranged an image forming section P which forms a monochrome image through the processes of electrostatic charging, exposure to light, image development, and image transfer. In the image forming section P, there are arranged, along the rotation direction of a photosensitive drum 5 (counter-clockwise in FIG. 1), a charging device 4, an exposure unit (such as a laser scanning unit) 7, a developing device 8, a transfer roller 14, a cleaning device 19, and a destaticizing device 6.

During image formation, the photosensitive drum 5 rotating counter-clockwise is electrostatically charged uniformly by the charging device 4. Then, a laser beam based on document image data from the exposure unit 7 forms an electrostatic latent image on the photosensitive drum 5.

Then, the developing device 8 attaches developer (hereinafter referred to as toner) to the electrostatic latent image, so that a toner image is formed on the photosensitive drum 5.

The toner is supplied to the developing device 8 from a toner container 9. The image data is transmitted from a host device such as a personal computer (unillustrated) to the image forming apparatus 100. The destaticizing device 6 for eliminating the residual electric charge on the surface of the photosensitive drum 5 is disposed on the downstream side of the cleaning device 19 in the rotation direction of the photosensitive drum 5.

The charging device 4, the photosensitive drum 5, and the cleaning device 19 are integrated into a unit, and the developing device 8 and the toner container 9 are integrated into a unit. In the following description, the unit including the charging device 4, the photosensitive drum 5, and the cleaning device 19 will be referred to as the drum unit 30 (image carrying body unit, see FIG. 2). The unit including the developing device 8 and the toner container 9 will be referred to as the developing unit 70. The drum unit 30 and the developing unit 70 are removably attached to the image forming apparatus 100.

Toward the photosensitive drum 5 on which the toner image has been formed as described above, a sheet is conveyed from a sheet feed cassette 10 or a manual sheet feed device 11 via a sheet conveying passage 12 and a pair of registration rollers 13. Then, the toner image formed on the surface of the photosensitive drum 5 is transferred to the sheet by a transfer roller 14 (image transfer portion). The sheet having the toner image transferred to it is separated from the photosensitive drum 5, and is conveyed to a fixing device 15, where the toner image is fixed to the sheet. The sheet having passed through the fixing device 15 is conveyed through a sheet conveying passage 16 to an upper part of the apparatus, and is discharged onto a discharge tray 18 by a pair of discharge rollers 17.

In the top face of the image forming apparatus 100, there is provided an openable cover 18*a* that forms a part of the discharge tray 18. With the openable cover 18*a* open, the drum unit 30 and the developing unit 70 can be inserted into the image forming apparatus 100, and can be drawn out of the image forming apparatus 100.

Figure 2:
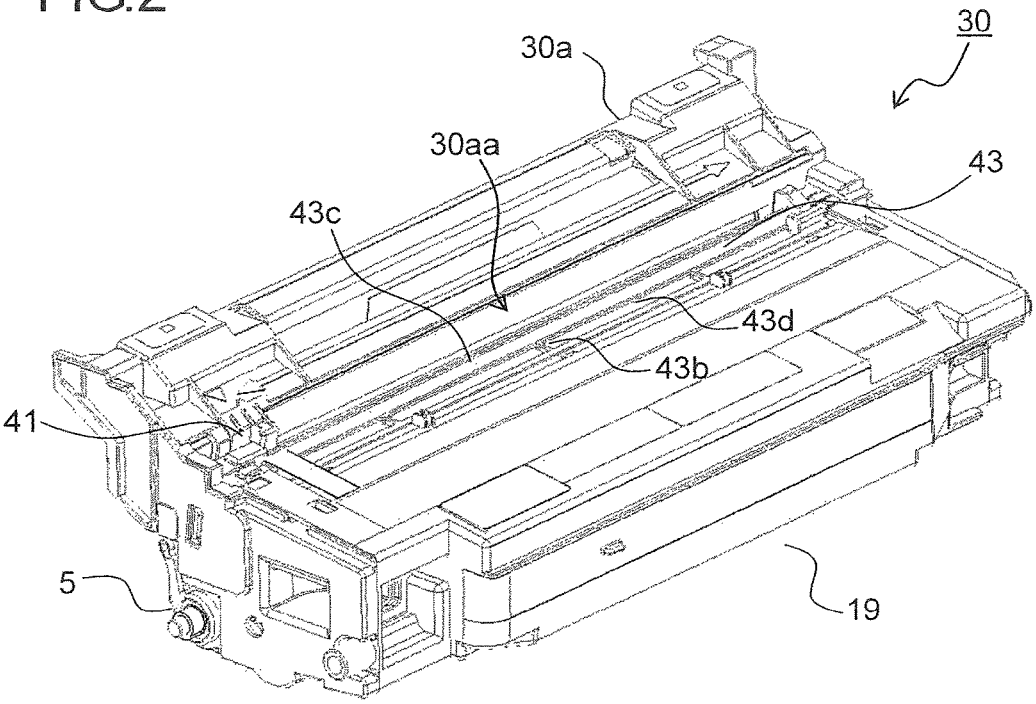
FIG. 2 is an exterior perspective view of a drum unit according to one embodiment of the present disclosure.
Figure 3:
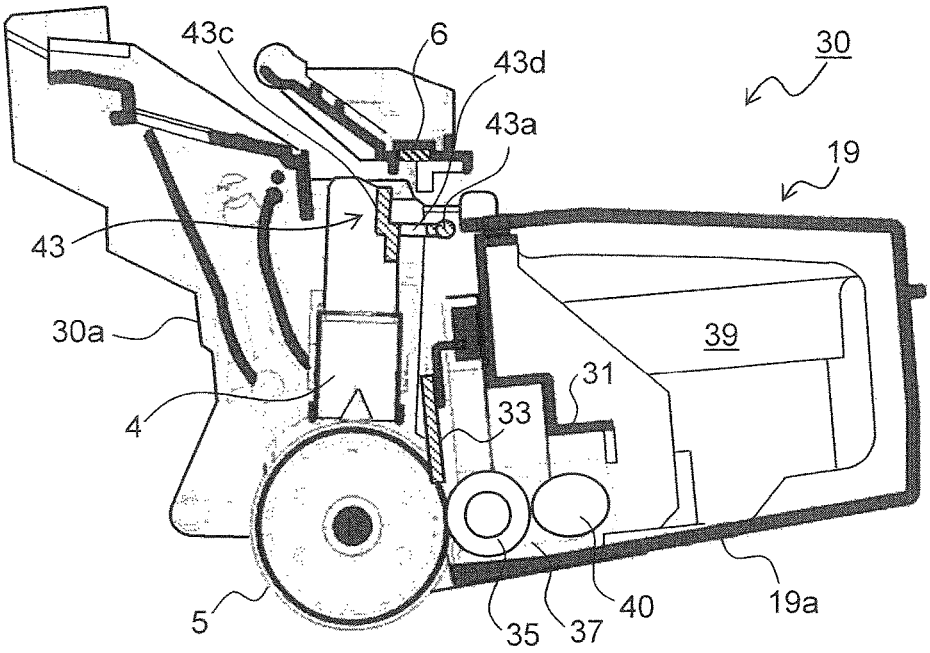
FIG. 3 is a side sectional view of the drum unit according to the embodiment.
Figure 4:
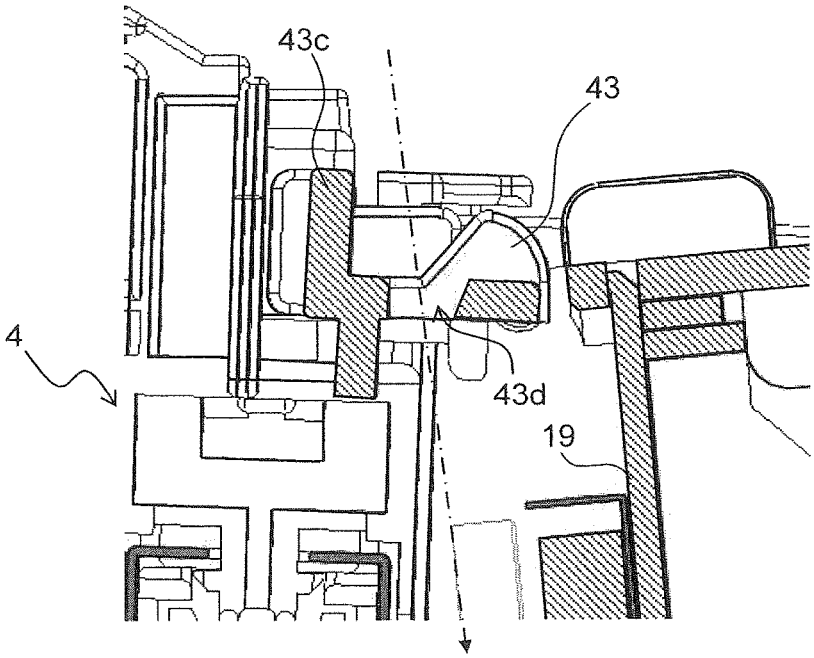
FIG. 4 is an enlarged sectional view around the cover member in FIG. 3.
Figure 5:
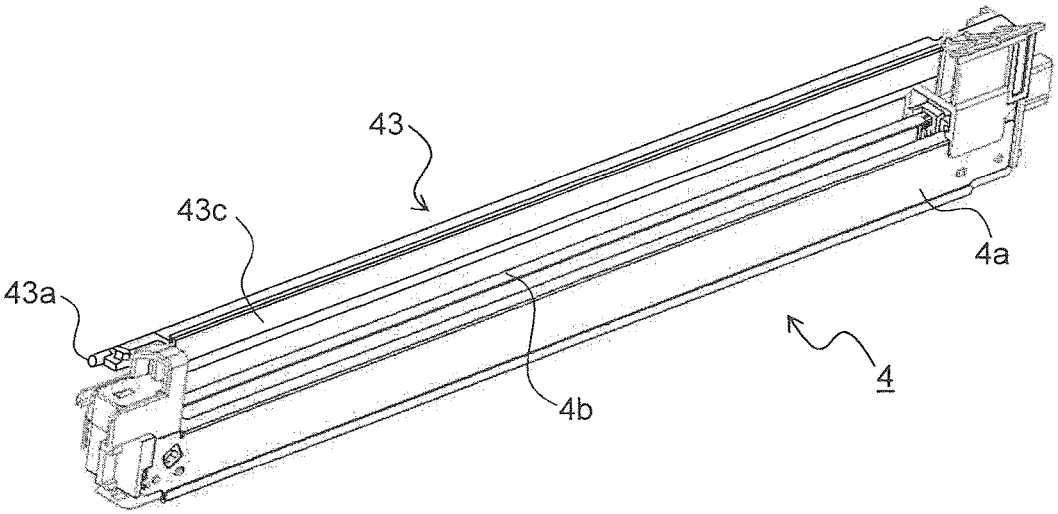
FIG. 5 is an exterior perspective view of a charging device provided in the drum unit.

FIG. 2 is an exterior perspective view of the drum unit 30, to be incorporation in the image forming apparatus 100, according to one embodiment of the present disclosure. FIG. 3 is a side sectional view of the drum unit 30. FIG. 4 is an enlarged sectional view around the cover member 43 in FIG. 3. FIG. 5 is a perspective view of the charging device 4 provided in the drum unit 30. In FIG. 3, for the sake of convenience of description, the destaticizing device 6, which is arranged in the image forming apparatus 100, is shown together. In FIG. 5, the charging device 4 is shown as seen from the side (the left side in FIG. 3) opposite from the cover member 43.

In the drum unit 30, the photosensitive drum 5, the charging device 4 (second unit), and the cleaning device 19 are held together in a unit housing 30*a* (first unit). A housing 19*a* of the cleaning device 19 has an open part at a side of the photosensitive drum 5, and forms a part of the unit housing 30*a*. The inside of the housing 19*a* is divided into two parts by a partition wall 31, and on the photosensitive drum 5 side of the partition wall 31, there is provided a toner scraping portion 37 in which a cleaning blade 33 and a cleaning roller 35 are arranged.

On the opposite side of the partition wall 31 from the toner scraping portion 37, there is provided a waste toner storage 39 in which the waste toner scraped off the photosensitive drum 5 by the cleaning blade 33 and the cleaning roller 35 is stored. The toner scraping portion 37 and the waste toner storage 39 communicate with each other under the partition wall 31, and are provided with a sweep roller 40 which sweeps the waste toner in the toner scraping portion 37 to the communicating portion.

In the unit housing 30*a*, there is arranged a cover member 43 which opens and closes an opening 30*aa*. The cover member 43 serves also as a light-shielding member that shields the light (destaticizing light) radiated from the destaticizing device 6. The cover member 43 is a substantially T-shaped member as seen in a side view that is composed of pivot shafts 43*a* formed in each end part of the cover member 43 in its length direction and supported pivotably on the unit housing 30*a*, an arm portion 43*b* coupled to the pivot shafts 43*a*, and a light-shielding plate 43*c* perpendicular to the arm portion 43*b*. The arm portion 43*b* has a window 43*d* formed in it.

FIG. 3 shows a state where the drum unit 30 is attached to the image forming apparatus 100, and where the cover member 43 is located in a closed position (first position). In the closed position, the cover member 43 shields, with the light-shielding plate 43*c*, the destaticizing light radiated from the destaticizing device 6 so that it does not enter the charging device 4. As shown in FIG. 4, the destaticizing light (indicated by a dash-dot line arrow) radiated from the destaticizing device 6 passes through the window 43*d* in the cover member 43, then passes through the gap between the charging device 4 and the cleaning device 19, and then reaches the surface of the photosensitive drum 5 (see FIG. 3).

The charging device 4 is disposed so as to face the photosensitive drum 5 substantially over the entire region of the photosensitive drum 5 in its length direction (the direction perpendicular to the plane of FIG. 3). As shown in FIG. 5, the charging device 4 is of a scorotron type composed of a shield member (casing) 4*a* with a U-shaped cross section having an open part toward the surface of the photosensitive drum 5, a corona wire 4*b* to which a high voltage is applied, and a grid (unillustrated) provided in the open part of the shield member (casing) 4*a*. Through corona discharge from the corona wire 4*b* via the grid, the charging device 4 electrostatically charges the surface of the photosensitive drum 5 with a predetermined positive potential (the same polarity as the toner). The charging device 4 is removably attached to the drum unit 30 to enable maintenance and replacement. The charging device 4 can be removed from the unit housing 30*a* by being drawn out through the opening 30*aa* formed on an upper surface of the unit housing 30*a*, and can be attached to the unit housing 30*a* by being inserted through the opening 30*aa*.

Figure 6:
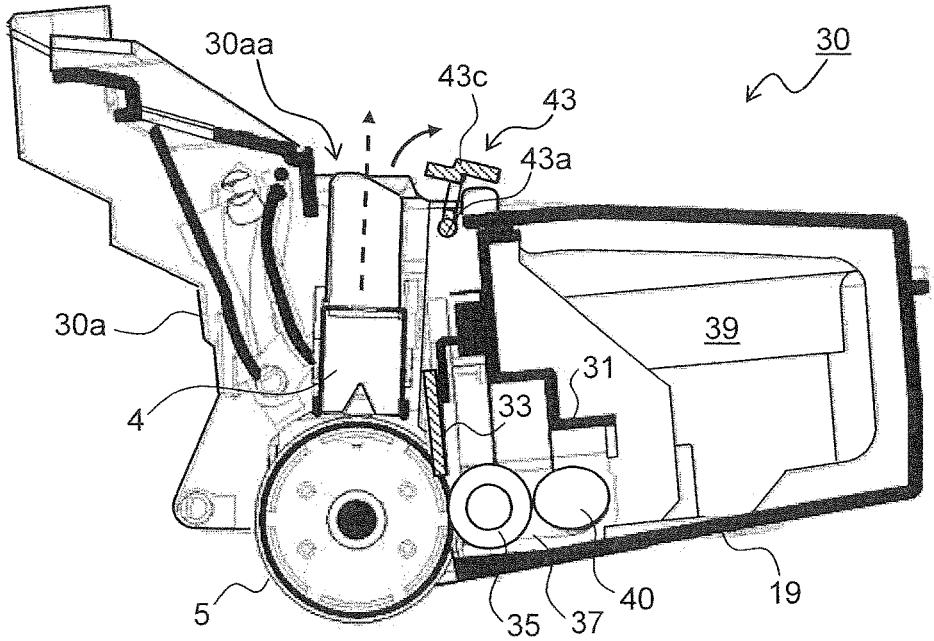
FIG. 6 is a side sectional view of the drum unit as observed when, with the cover member open, the charging device is removed.
Figure 7:
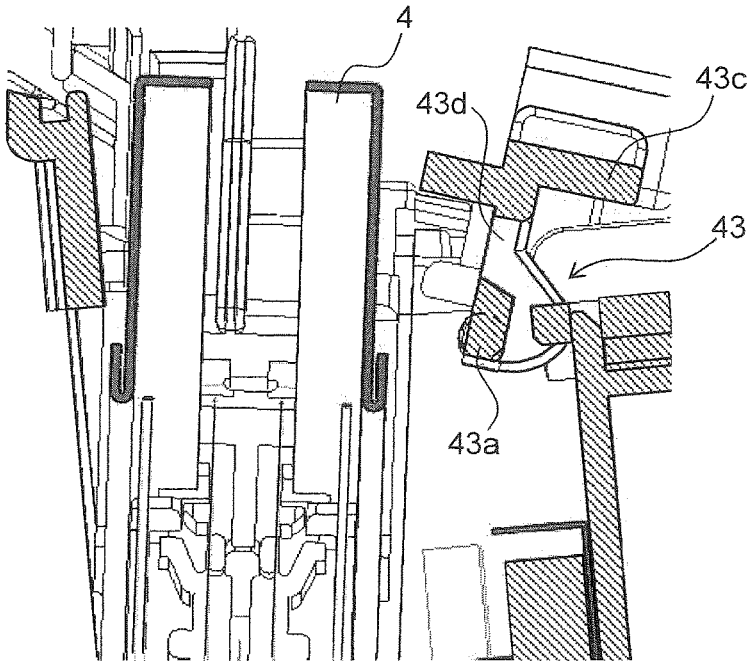
FIG. 7 is an enlarged sectional view around the cover member in FIG. 6.
Figure 8:
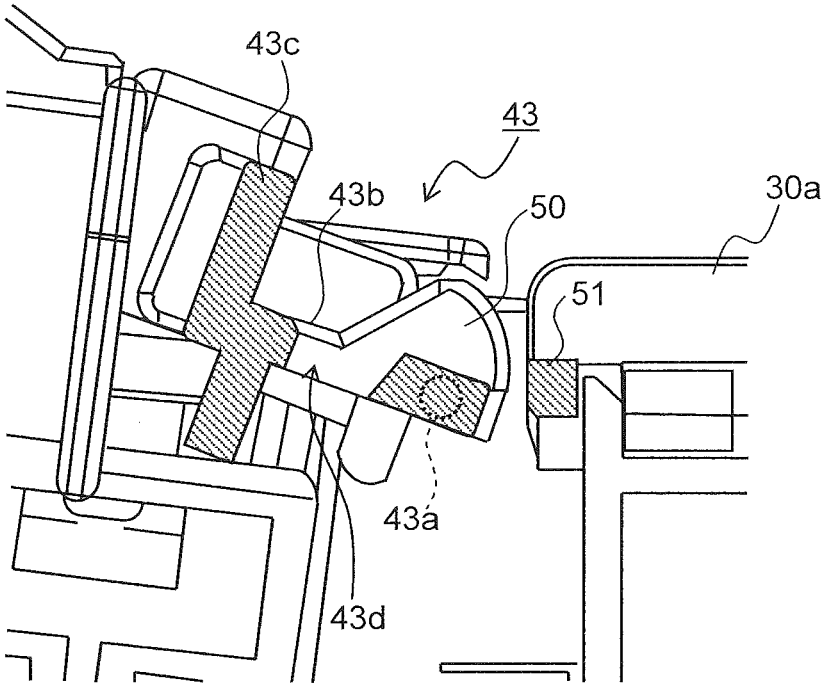
FIG. 8 is an enlarged sectional view around the cover member of the drum unit, showing a state where the cover member is in a closed position.

FIG. 6 is a side sectional view of the drum unit 30 as observed when, with the cover member 43 open, the charging device 4 is removed. FIG. 7 is an enlarged sectional view around the cover member 43 in FIG. 6. FIGS. 8 to 11 are enlarged sectional views around the cover member 43 in the drum unit 30, depicting how the cover member 43 pivots from the closed position to the open position. With the drum unit 30 drawn out of the image forming apparatus 100, as shown in FIGS. 3, 4, and 8, the cover member 43 is located in the closed position where it closes the opening 30*aa*. In the state in FIG. 8, as in FIG. 4, the destaticizing light from the destaticizing device 6 (see FIG. 3) passes through the window 43*d* in the cover member 43 to shine the surface of the photosensitive drum 5. On the other hand, the destaticizing light radiated from the destaticizing device 6 toward the charging device 4 is shielded by the light-shielding plate 43*c*.

On each of the pivot shafts 43*a* of the cover member 43, a rib 50 that protrudes in a direction radial to it is formed. The ribs 50 have the shape of a cam in which the distance from the pivot shaft 43*a* to the outer circumferential edge changes continuously. Each of the ribs 50 are formed at one place substantially in a central part of the pivot shafts 43*a* in its axial direction. In the unit housing 30*a*, at a position facing the rib 50 in the axial direction of the pivot shaft 43*a*, a restricting portion 51 is formed. As shown in FIG. 8, when the cover member 43 is located in the closed position, the rib 50 and the restricting portion 51 do not make contact with each other but face each other across a predetermined interval.

To remove the charging device 4 from the drum unit 30, the cover member 43 is pivoted in the opening direction from the state in FIG. 8. Specifically, the cover member 43 is pivoted about the pivot shaft 43*a* clockwise from the position in FIG. 8. When it is pivoted through a predetermined angle in the opening direction from the position in FIG. 8, as shown in FIG. 9, the outer circumferential edge of the rib 50 makes contact with the restricting portion 51 of the unit housing 30*a*.

The rib 50 is designed such that, as the cover member 43 pivots clockwise from the closed state, the outer diameter of the part of the rib 50 facing the restricting portion 51 increases continuously. Thus, as the cover member 43 is pivoted further clockwise from the position in FIG. 9, the amount of overlap (pressing force) of the rib 50 with (against) the restricting portion 51 increases gradually.

Figure 9:
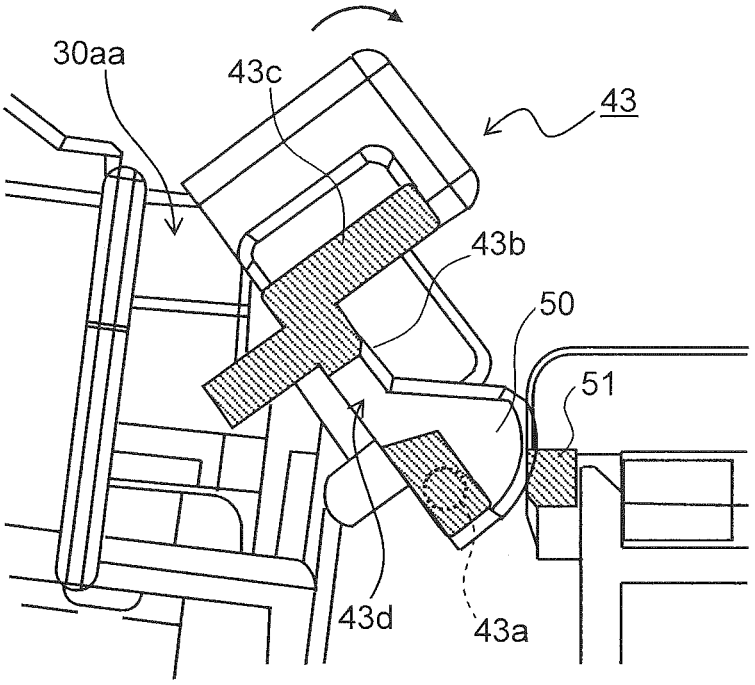
FIG. 9 is an enlarged sectional view around the cover member of the drum unit, showing a state where the cover member has pivoted a predetermined angle from the closed position.
Figure 10:
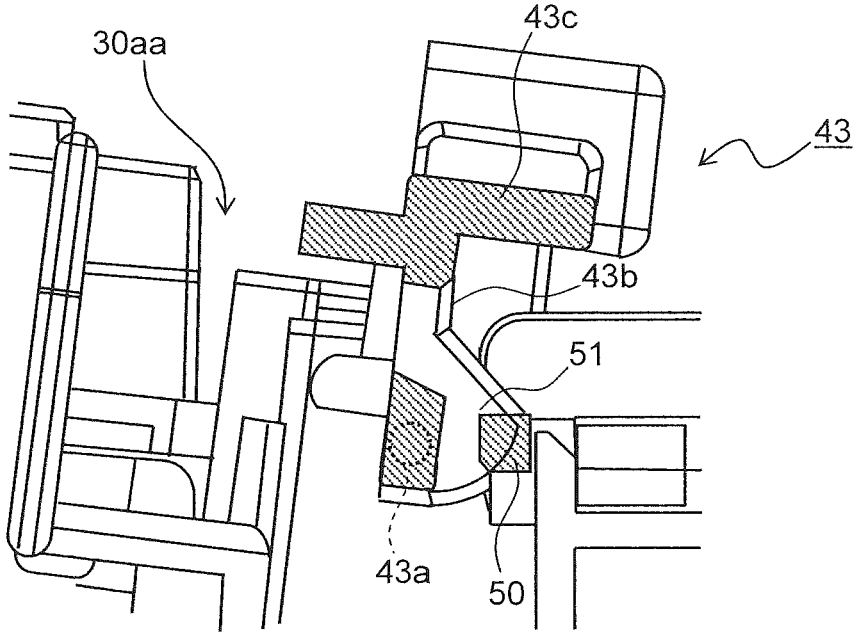
FIG. 10 is an enlarged sectional view around the cover member of the drum unit, showing a state where the cover member is at a singular point.

When the cover member 43 pivots through a predetermined angle from the position in FIG. 9, as shown in FIG. 10, the cover member 43 is located at a singular point (third position) at which the amount of overlap (pressing force) of the rib 50 with (against) the restricting portion 51 is at the maximum.

The rib 50 is designed such that, as the cover member 43 pivots clockwise from the singular point, the outer diameter of the part of the rib 50 facing the restricting portion 51 decreases continuously. Thus, when the cover member 43 is pivoted further clockwise from the position in FIG. 10, the amount of overlap (pressing force) of the rib 50 with (against) the restricting portion 51 decreases gradually.

Figure 11:
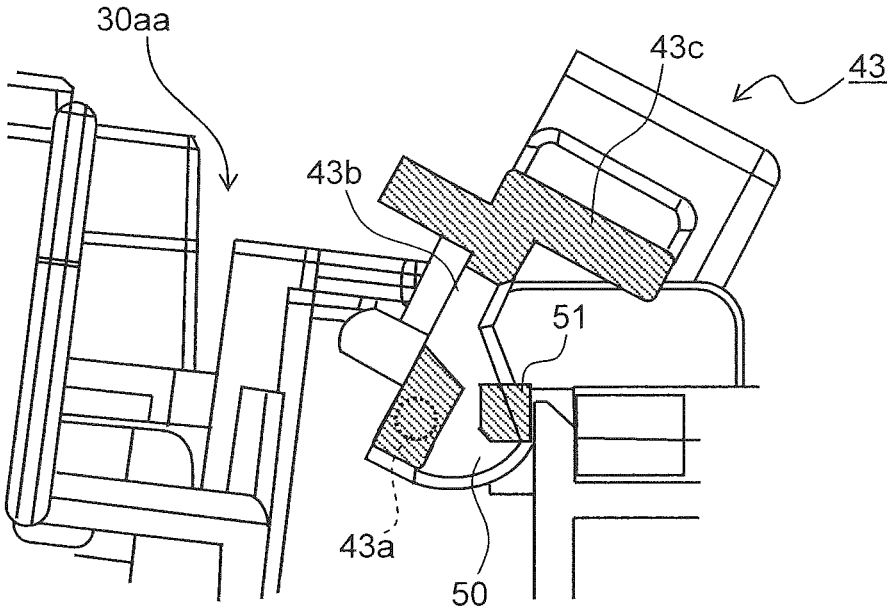
FIG. 11 is an enlarged sectional view around the cover member of the drum unit, showing a state where the cover member is in an open position.

When the cover member 43 pivots through a predetermined angle from the position in FIG. 10, as shown in FIG. 11, the cover member 43 is located in the open position (second position) where the cover member 43 leaves the opening 30*aa* open. In the open position, the cover member 43 is retracted from the attachment/removal path of the charging device 4, and therefore there is no danger of the charging device 4 interfering with the unit housing 30*a* when the former is drawn out of the latter.

After the charging device 4 is drawn out, the cover member 43 is located in the open position; thus, when the charging device 4 is attached back to the drum unit 30, the charging device 4 can be inserted through the opening 30*aa* with no contact with the cover member 43.

With the structure according to the embodiment, when the cover member 43 located in the closed position is pivoted in the opening direction, until the cover member 43 reaches the singular point, the pressing force of the rib 50 against the restricting portion 51 increases continuously. Thus, when the cover member 43 pivots from the closed position to the singular point, a force (reaction force) that restricts the pivoting of the cover member 43 in the opening direction acts. This prevents the cover member 43 from moving from the closed position to the open position with vibration or impact when the drum unit 30 is inserted into the image forming apparatus 100, and ensures that the destaticizing light from the destaticizing device 6 is shielded by the light-shielding plate 43*c* of the cover member 43.

On the other hand, when the cover member 43 is pivoted in the opening direction beyond the singular point, the pressing force of the rib 50 against the restricting portion 51 decreases continuously. Thus, when the cover member 43 pivots from the open position to the singular point, a force (reaction force) that restricts the pivoting of the cover member 43 in the closing direction acts. This permits the cover member 43 to be automatically held in the open position, and eliminates the need, for example, to hold the cover member 43 with a hand when attaching or removing the charging device 4, leading to improved user-friendliness.

When the cover member 43 is in the closed position, the rib 50 of the cover member 43 and the restricting portion 51 of the unit housing 30*a* are located away from each other. Thus, with the cover member 43 in the closed position, no load acts on the cover member 43 from the restricting portion 51 via the rib 50, and this helps prevent deformation of the cover member 43 leading to malfunction such as failure to shield the destaticizing light.

Although here a structure is adopted where the outer diameter of the rib 50 changes continuously to allow the pressing force of the rib 50 against the restricting portion 51 to change continuously, instead a structure is also possible where steps are formed on the rib 50 and, as the cover member 43 moves from the closed position to the open position, it goes over the steps so that the pressing force against the restricting portion 51 changes stepwise. In that case, when the cover member 43 is operated it needs to go over the steps, making the cover member 43 less comfortable to operate. For this reason, a structure where as in the embodiment described above the pressing force changes continuously is preferable.

As mentioned earlier, with the charging device 4 inserted in the unit housing 30*a*, the cover member 43 is located in the open position. With the cover member 43 located in the open position, inserting the drum unit 30 into the image forming apparatus 100 causes the cover member 43 to shield the optical path of the destaticizing light from the destaticizing device 6 to the photosensitive drum 5, inconveniently making it impossible to eliminate the residual electric charge on the surface of the photosensitive drum 5. To avoid that, in the embodiment, in the image forming apparatus 100, a cover moving member 60 is provided so that, when the drum unit 30 is inserted into the image forming apparatus 100, the cover member 43 is automatically moved to the closed position.

Figure 12:
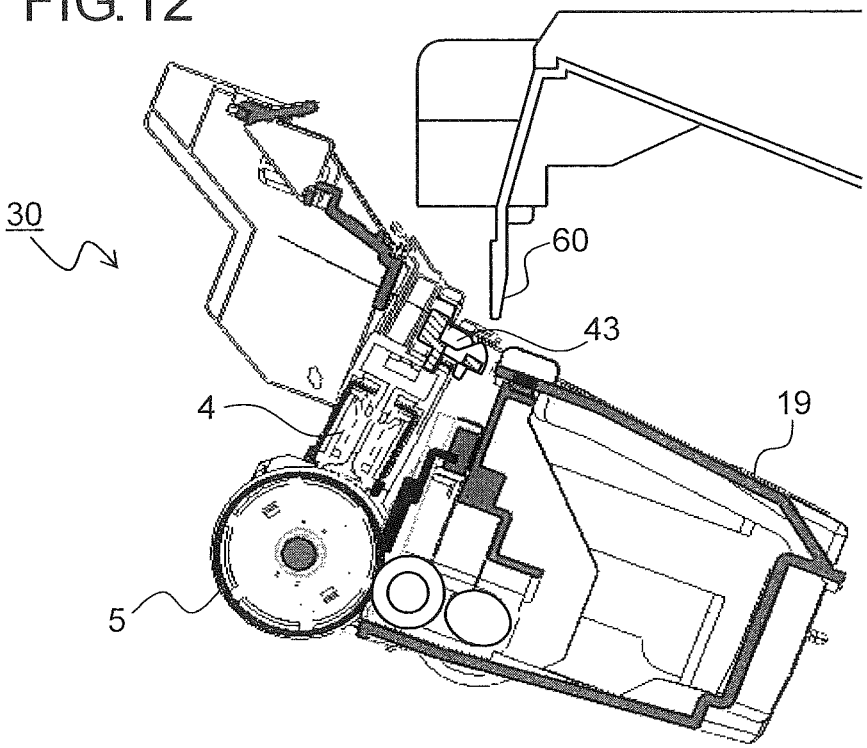
FIG. 12 is a side sectional view showing how, with the cover member in the closed position, the drum unit is inserted into the main body of the image forming apparatus.

FIG. 12 is a side sectional view showing how, with the cover member 43 located in the closed position, the drum unit 30 is inserted into the image forming apparatus 100. As the drum unit 30 is inserted in the attaching direction (the right and downward direction in FIG. 12) along a guide groove (unillustrated) formed in the image forming apparatus 100, while the cover member 43 is kept in the closed position without making contact with the cover moving member 60, the drum unit 30 is inserted up to a predetermined position inside the image forming apparatus 100. With the drum unit 30 inserted up to the predetermined position, the center shaft of the photosensitive drum 5 is located in a positioning portion (unillustrated) formed in an end part of the guide groove, and the photosensitive drum 5 and the transfer roller 14 (see FIG. 1) make contact with each other to form a transfer nip.

Figure 13:
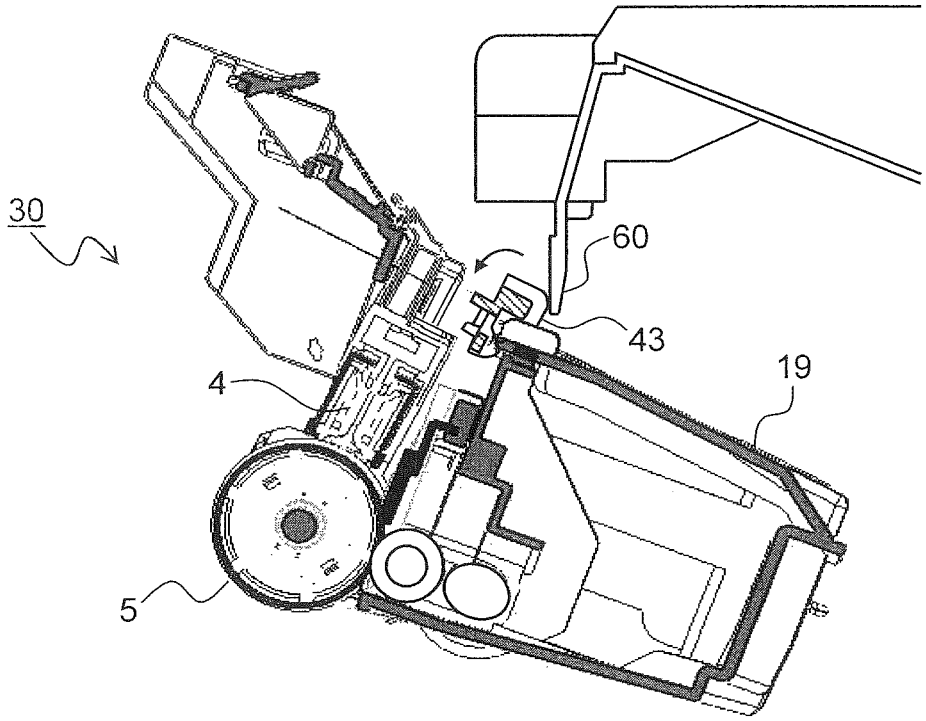
FIG. 13 is a side sectional view showing how, with the cover member in the open position, the drum unit is inserted into the main body of the image forming apparatus.

FIG. 13 is a side sectional view showing how, with the cover member 43 located in the open position, the drum unit 30 is inserted into the image forming apparatus 100. As the drum unit 30 is inserted, as in FIG. 12, in the attaching direction (the right and downward direction in FIG. 12) along the guide groove (unillustrated) formed in the image forming apparatus 100, before the drum unit 30 is inserted up to a predetermined position inside the image forming apparatus 100, the light-shielding plate 43*c* of the cover member 43 makes contact with the cover moving member 60 provided in the image forming apparatus 100. Thus, the cover member 43 pivots about the pivot shaft 43*a* counter-clockwise in FIG. 13, and moves to the closed position.

Thus, the operation of attaching the drum unit 30 to the image forming apparatus 100 causes the cover member 43 located in the open position to automatically move to the closed position. This eliminates the need to perform the operation of returning the cover member 43 from the open position to the closed position when the drum unit 30 is attached, and prevents the cover member 43 from being forgotten to be returned to the closed position.

The present disclosure is not limited to the embodiment described above and allows for many modifications without departing from the spirit of the present disclosure. For example, although the embodiment described above deals with an example where use is made of a charging device 4 of a scorotron type that has a corona wire 4*b* and a grid, the present disclosure is applicable equally to a case where use is made of a charging device of a contact charge type provided with a charging roller that makes contact with the photosensitive drum 5.

Although the embodiment described above deals with an example of, in a drum unit 30 removably attached to the image forming apparatus 100, a structure of a cover member 43 that is opened and closed when a charging device 4 is attached to or removed from the drum unit 30, the present disclosure is applicable equally to any unit other than a drum unit so long as it is a removable unit that is removably attached to an image forming apparatus and that includes a cover member that is opened and closed when another unit is attached or removed.

The present disclosure is applicable not only to monochrome printers like the one shown in FIG. 1 but, needless to say, also to any other types of image forming apparatuses provided with a removable unit, such as color printers, monochrome and color copiers, digital multifunction peripheral, and facsimile machines.

The present disclosure finds applications in removable units that are removably attached to the main body of an image forming apparatus. Based on the present disclosure, it is possible to provide removable units that can, with a simple structure, temporarily hold in an open position and a closed position a cover member that opens and closes when another unit is attached to or removed from the main body of the unit.

What is claimed is:

1. A removable unit, comprising:

a first unit removably attached to an image forming apparatus;

a second unit held by being removably attached to the first unit;

a cover member supported pivotably on the first unit, the cover member being locatable selectively either in a first position overlapping an attachment/removal path of the second unit or a second position not overlapping the attachment/removal path of the second unit, wherein when the cover member pivots from the first position to a third position pivoted through a predetermined angle from the first position toward the second position, from the first unit a reaction force acts on the cover member to restrict pivoting toward the second position and, when the cover member pivots from the second position to the third position, from the first unit a reaction force acts on the cover member to restrict pivoting toward the first position.

2. The removable unit of claim 1, wherein a rib that protrudes from a pivot shaft of the cover member in a direction radial thereto is formed on the cover member, a distance from the pivot shaft to an outer circumferential edge of the rib changing continuously, and a restricting portion contactable with the rib is formed on the first unit, at a position facing the rib, when the cover member pivots from the first position to the third position, an outer diameter of a part of the rib facing the restricting portion increases continuously and, when the cover member pivots from the third position to the second position, the outer diameter of the part of the rib facing the restricting portion decreases continuously.

3. The removable unit of claim 2, wherein when the cover member is in the first position, the rib is away from the restricting portion.

4. The removable unit of claim 1, wherein attaching the removable unit to the image forming apparatus causes the cover member to move from the second position to the first position.

5. The removable unit of claim 4, wherein the cover member moves from the second position to the first position by making contact with a cover moving member provided on the image forming apparatus.

6. The removable unit of claim 1, wherein the removable unit is an image carrying body unit including:

an image carrying body on which an electrostatic latent image is formed;

a charging device as the second unit for electrostatically charging a surface of the image carrying body; and a unit housing as the first unit for holding together the image carrying body and the charging device.

7. The removable unit of claim 6, wherein the cover member, when in the first position, shields destaticizing light radiated from a destaticizing device provided in the image forming apparatus onto the image carrying body to prevent the destaticizing light from entering the charging device.

8. The removable unit of claim 7, wherein the cover member is substantially T-shaped as seen in a side view, being composed of a pivot shaft supported pivotably on the unit housing, an arm portion coupled to the pivot shaft, and a light-shielding plate perpendicular to the arm portion, the arm portion having formed therein a window through which the destaticizing light passes when the cover member is in the first position.

9. An image forming apparatus comprising the removable unit of claim 1.

* * * * *